US006223572B1

(12) United States Patent
Marttinen

(10) Patent No.: US 6,223,572 B1
(45) Date of Patent: May 1, 2001

(54) DOOR LOCK FURNITURE

(76) Inventor: Asa Alfret Marttinen, 112 Denwood Drive, Sault St. Marie, On. (CA), P6A 6T3

( * ) Notice: Subject to any disclaimer, the term of this patent is extended or adjusted under 35 U.S.C. 154(b) by 0 days.

(21) Appl. No.: 09/392,525

(22) Filed: Sep. 9, 1999

(51) Int. Cl.[7] ..... E05B 9/08

(52) U.S. Cl. ..... 70/370; 70/451; 292/348; 292/357

(58) Field of Search ..... 70/370–372, 448–452, 70/224; 292/340, 341.14, 336.3, 348, 350, 352, 355–357, DIG. 30; 411/340, 345

(56) References Cited

U.S. PATENT DOCUMENTS

| | | | | |
|---|---|---|---|---|
| 48,024 | * | 5/1865 | Nobles | 292/348 |
| 481,519 | * | 8/1892 | Ashley | 292/348 |
| 2,329,379 | * | 9/1943 | Andersen | 292/348 |
| 2,440,509 | * | 4/1948 | Hagstrom | 292/348 |
| 2,537,263 | * | 1/1951 | Fogle | 411/345 X |
| 2,759,754 | * | 8/1956 | Kaiser | 292/357 X |
| 3,044,817 | * | 7/1962 | Marcante | 292/348 X |
| 3,065,014 | * | 11/1962 | Russell | 292/348 X |
| 3,508,777 | * | 4/1970 | McBurnie | 292/357 X |
| 3,550,411 | * | 12/1970 | Neary et al. | 70/416 |
| 4,306,468 | * | 12/1981 | Bolgert | 292/348 X |
| 4,317,588 | * | 3/1982 | Marchal et al. | 292/341.14 |
| 4,679,420 | * | 7/1987 | Yang | 292/348 X |
| 5,156,482 | * | 10/1992 | Owings | 411/340 X |
| 5,409,278 | * | 4/1995 | Harcourt | 292/348 X |
| 5,411,303 | * | 5/1995 | To | 292/357 |
| 5,722,273 | * | 3/1998 | Lin et al. | 292/357 X |
| 5,757,269 | * | 5/1998 | Roth et al. | 292/340 X |

FOREIGN PATENT DOCUMENTS

| | | | | |
|---|---|---|---|---|
| 422489 | * | 1/1935 | (GB) | 292/341.14 |

* cited by examiner

*Primary Examiner*—Suzanne Dino Barrett
(74) *Attorney, Agent, or Firm*—D. W. Eggins

(57) ABSTRACT

A door lock for use with a door having a through bore and an intermediate transverse aperture connecting said bore with an edge of the door, into which through bore actuator portions of the lock are inserted, and through which transverse aperture a latch portion of the lock is inserted; the lock having an outer first portion insertable into an outer portion of the through bore, an inner second lock portion insertable into an inner portion of the through bore, the lock first portion having at its inner end a laterally extending slot to receive the latch portion in entered relation therein, the lock second portion having a threaded cylindrical portion at its inner end, the lock first portion having a threaded inner end portion to make threaded engagement with the lock second portion, enabling rapid mounting of a lock within a door. Alternative embodiments of rapid-mounting door locks may include a bayonet fitting, or the use of adjustable screws with latch-head fittings, both embodiments of which permit raped installation of the door lock furniture. A novel latchplate arrangement includes a base portion and a clip-on cover portion, suitable for use with existing lock arrangements, and the subject locks.

10 Claims, 4 Drawing Sheets

16
14
12
17
20
22
22
26
24
40
37
36
42
30
34

30'
37
36
49
47
42
34

36
34
44
46

12'
14
17
94
92
94
20'

14
12
60
76
14
95
14
30
20"
95

DOOR LOCK FURNITURE

BACKGROUND OF THE INVENTION

1. Field of the Invention

This invention is directed to security hardware, and in particular to a door lock furniture system, including lock and jamb fittings and their method of installation.

2. Description of the Prior Art

Conventional lock furniture for doors consists of the hardware that is fitted to the door for securing it, and comprises a latch assembly containing a movable latch portion within an elongated housing, which assembly is inserted into a recess in the door edge; and outer and inner actuator portions secured to the outer and inner faces of the door, which are assembled to the door, by insertion into respective outer and inner portions of a through-bore located adjacent the door edge, and which intercepts the latch assembly. A pair of elongated securing screws, inserted form the door inner side through the inner actuator portion, are screwed into projecting post portions of the outer actuator portion, serving to draw the two actuator portions together in mutually securing, aligned relation. In the case of a door furniture assembly having two door handles, the actuator portions each includes a handle portion, the handle of the outer actuator portion including a keyhole to receive a door key; the inner handle portion being axally movable, or possessing a relatively rotatable handle portion, by means of which respective movements the lock can be engaged or disengaged by a user located inside the door.

The door key usually serves only to unlock the latch, thus permitting the opening of the door by way of either of the two handles.

In the case of a deadbolt installation, the lock outer actuator portion usually consists of a key boss, having a keyhole to receive a door key; the inner actuator portion consisting of a boss having a rotatable latch handle, to operate the deadbolt from inside the door.

With a deadbolt type lock, the key is operable to unlock, and also to apply the lock. The reliance upon a pair of screws to hold door lock furniture in secure assembled relation represents a point of weakness in the system, because such screws are subject to backing off, i.e. to unscrew themselves, so as to become slack. In some instances this has even led to complete disengagement of one or both of the screws, with the door handle pulling free from off the door.

In the matter of installation, the securing screws present two problems. First, it is most difficult to align the elongated securing screws with the internally threaded bossed into which they must be threaded, due to their length and an absence of visual alignment, and any slackness in fit of the furniture within the through bore of the door. Also, in the case of a door handle assembly, the inner door handle usually overlies the securing screws, thus denying unobstucted, aligned access to the screw heads, which further impedes alignment of the screws, while also making it necessary to tighten the screws from an awkward, off-centre, misaligned position.

SUMMARY OF THE INVENTION

The present invention provides a first embodiment door lock for use with a door having a through bore and an intermediate transverse aperture connecting the bore with an edge of the door, through which bore actuator portions of the lock are inserted, and through which transverse aperture a latch portion of the lock is inserted; the lock having an outer first portion insertable into an outer portion of the bore, an inner second portion insertable into an inner portion of the bore, the lock first portion having at its inner end a laterally extending slot to receive the latch portion in entered relation therein, the lock second portion having a threaded cylindrical portion at its inner end; the lock first portion having a threaded inner end portion to make threaded engagement with the lock second portion. Thus there is provided a door lock for use in locking and unlocking a door, the lock having an outer first portion for installation at an outer face of the door, an inner second portion for installation at an inner face of the door, one lock portion including first securing means located at its inner end, the other lock portion incorporating receiving means adapted to receive the first securing means in secured relation therewith, in use to enable the first and the second lock portions to be secured in mutual positioning relation on opposite sides of the door.

In a first embodiment of the aforesaid door lock, the first securing means and the receiving means have threaded cylindrical portions in readly centered mutually engaging relation.

In another embodiment the door lock first securing means and the receiving means consist of two complementary halves of a bayonet fitting comprising at least one projecting lug, and at least one recess to receive the lug in entered, locking relation therewith.

In a further embodiment of the lock, the first securing means comprises a pair of post portions each having a turnbuckle at its end; the receiving means comprising a pair of slots in the other lock portion, each of the slots receiving a respective one of the turnbuckles in entered, externally accessible engaged relation therewith.

In the above-mentioned first embodiment, the lock outer portion has a transversely extending aperture therethrough to receive a latch portion of the lock in inserted relation therein, with the threaded cylindrical portions adjoining the side edges of the aperture. The aperture consists of a transverse slot, which enables the outer portion to be inserted in straddling relation with the latch portion of the lock, and the square section actuator bar to penetrate the square aperture within the latch. Thus, the open end of the slot enables the lock outer portion to be inserted past the already installed latch portion. The threads of the lock inner portion can then engage the cylindrical threaded portion of the lock outer portion, for tightening into mutual securing relation.

An elastomeric gasket may be interposed between one of the lock portion and the adjoining door surface, such that the door surface is protected; while the gasket also becomes compressed as the lock inner portion is rotated in tightening relation with the lock outer portion, to serve as a frictional retaining device and diminish the likelihood of loosening of the door lock furniture. The gasket, if used is preferably located on the inside. In the first embodiment a complementary cylindrical ring may be provided, in coaxial relation with the threaded inner lock portion, to support and stablize the two cylindrical threaded segments of the lock outer portion, such that these two segments are received in sliding, supported relation between a pair of coaxial cylinders, to sustain the threaded engagement between inner and outer lock portions as the threads are tightened.

It will be understod that locks in accordance with the present invention may incorporate one or more handles, and the latching provisions may be of the spring latch or the deadbolt variety, with the respective associated interior and exterior fitting of well known type.

BRIEF DESCRIPTION OF THE DRAWINGS

Certain embodiments of the invention are described by way of illustration, without limitation thereto other than as set forth in the accompanying claims, reference being made to the accompanying drawings, wherein:

DETAILED DESCRIPTION OF THE INVENTION

Figure 1:
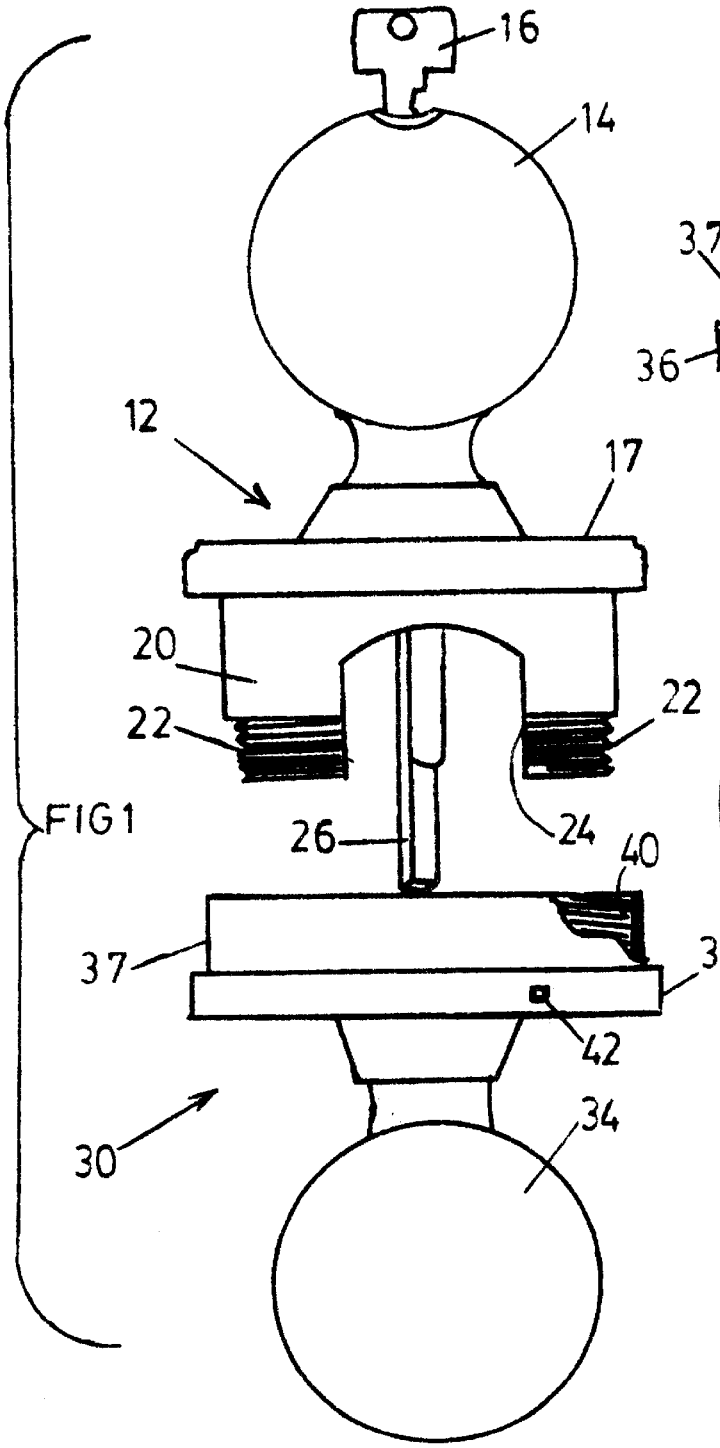
FIG. 1 is a side view of the relevant portions of door lock furniture, in a handled embodiment, in accordance with the present invention, in disassembled relation.

Referring to FIG. 1, The disassembled lock furniture 10 comprises a first, outer lock portion 12, for installation on the outside of a door, having a handle portion 14 with a key 16 shown in inserted relation therein. An outer boss portion 17 has an inwardly projecting cylindrical portion 20, illustrated as being externally threaded at 22, and sized to fit within the through-bore of a door lock aperture.

A transverse slot 24 accepts a latch mechanism (not shown), which does not form a part of the present invention, although being a necessary integer in the functioning of the lock 10. The latch may be of the spring latch or of the deadbolt type. A square section actuator bar 26 projects centrally of the outer lock portion 12, being operably connected with the mechanism of the key 16, in known fashion, and connecting the key 16 with the usual associated parts of the unlocking mechanism (not shown). An inner lock portion 30, for installation on the inner side of the door, has a handle portion 34 rotatably mounted on an inner boss portion 36. The inner boss portion 36 has a projecting cylindrical portion 37 that is sized to fit within the door through-bore.

An internally threaded portion 40 of the portion 37 engages the two halves of threaded portion 22 of the outer lock portion 12, upon rotation of the boss portion 36, drawing the outer lock portion 12 and the inner lock portion 30 towards each other and into pressing relation with the door, which is sandwiched between the outer boss portion 17 and the inner boss portion 36.

Figure 2:
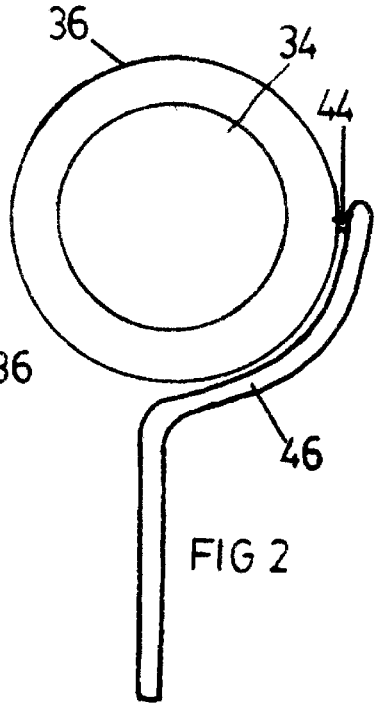
FIG. 2 is an end view showing an installation tool in applied relation with an inner lock portion.

A recess 42 in the boss 36 may be engaged, as seen in FIG. 2, by a projecting tooth portion 44 of an installation tool 46, such that angular rotation of the tool 46 in a clockwise direction, about the main axis of the lock 10 will rotate the boss portion 36, drawing it tight to the door face.

Figure 3:
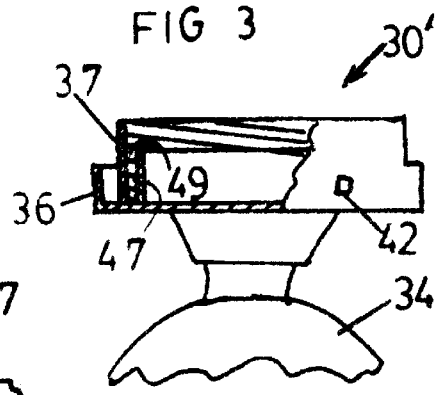
FIG. 3 is a scrap view in partial section of a second embodiment incorporating a reinforcing cylinder.

Referring to the FIG. 3 embodiment, an inner door portion 30' with handle portion 34 and boss portion 36 has a complementary cylindrical ring 47 within the annular portion 37. The annular recess 49 between the threaded portion 37 and the ring 47 is sized to receive the two threaded portions 22 of the outer lock portion 12 in snugly supported, threaded engagement therein, to preclude any tendency of the portions 22 to deflect inwardly, with consequent disengagement of the threads.

Figure 4:
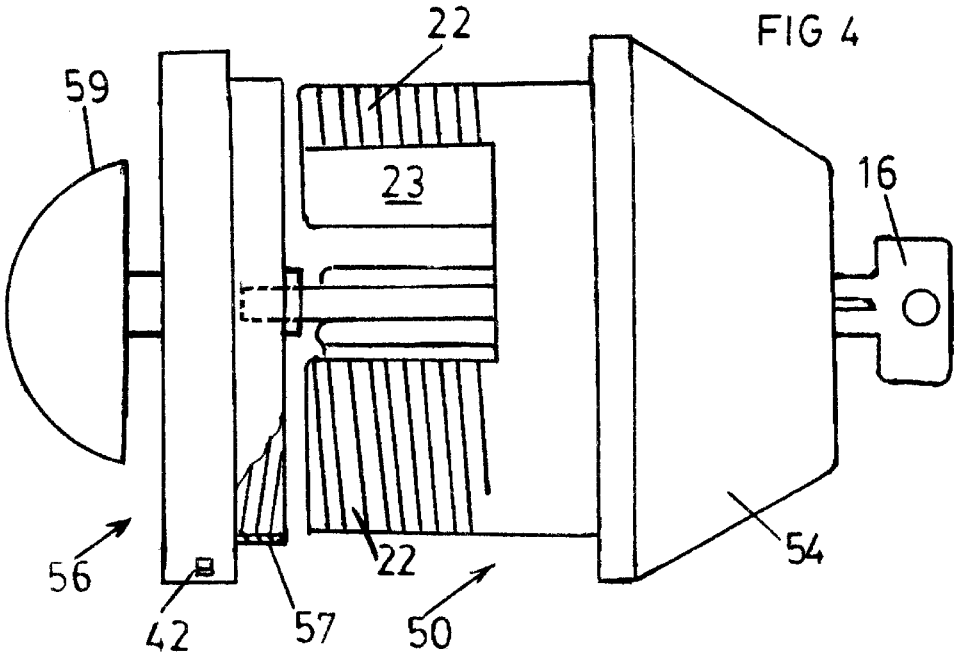
FIG. 4 is a view substantially corresponding to FIG. 1 of a dead-bolt embodiment of the present invention.

Turning to FIG. 4, the deadbolt installation 50 is shown in a partially rotated position to reveal the internal surface 23 of one of the two threaded portion 22. An external boss portion 54 has a key 16 shown in inserted relation. It will be understood that the deadbolt per se is not shown, and conforms with standard practice.

An internal boss portion 56 has an internally threaded cylindrical portion 57 to receive the threaded portion 22, in the fashion of the FIG. 1 embodiment. A latch handle 59 is rotatably mounted on the boss portion 56, to enable engagement and disengagement of the deadbolt from inside the door, in the usual fashion.

Figure 5:
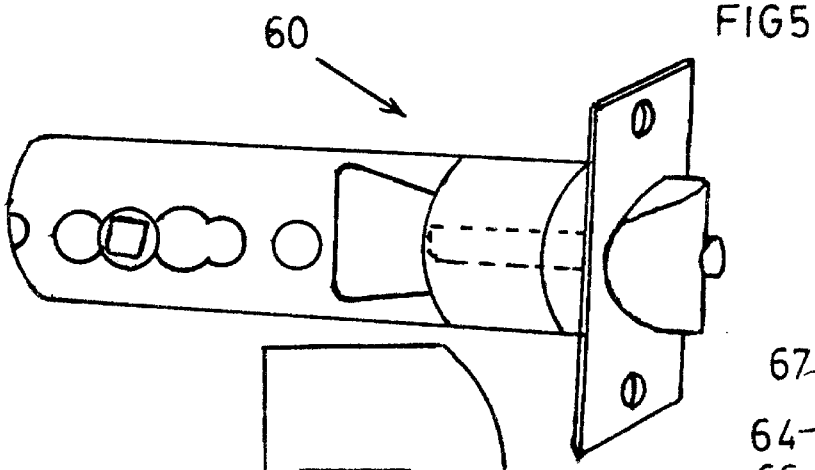
FIG. 5 is a side perspective view of a spring latch portion of the subject locks.
Figure 8:
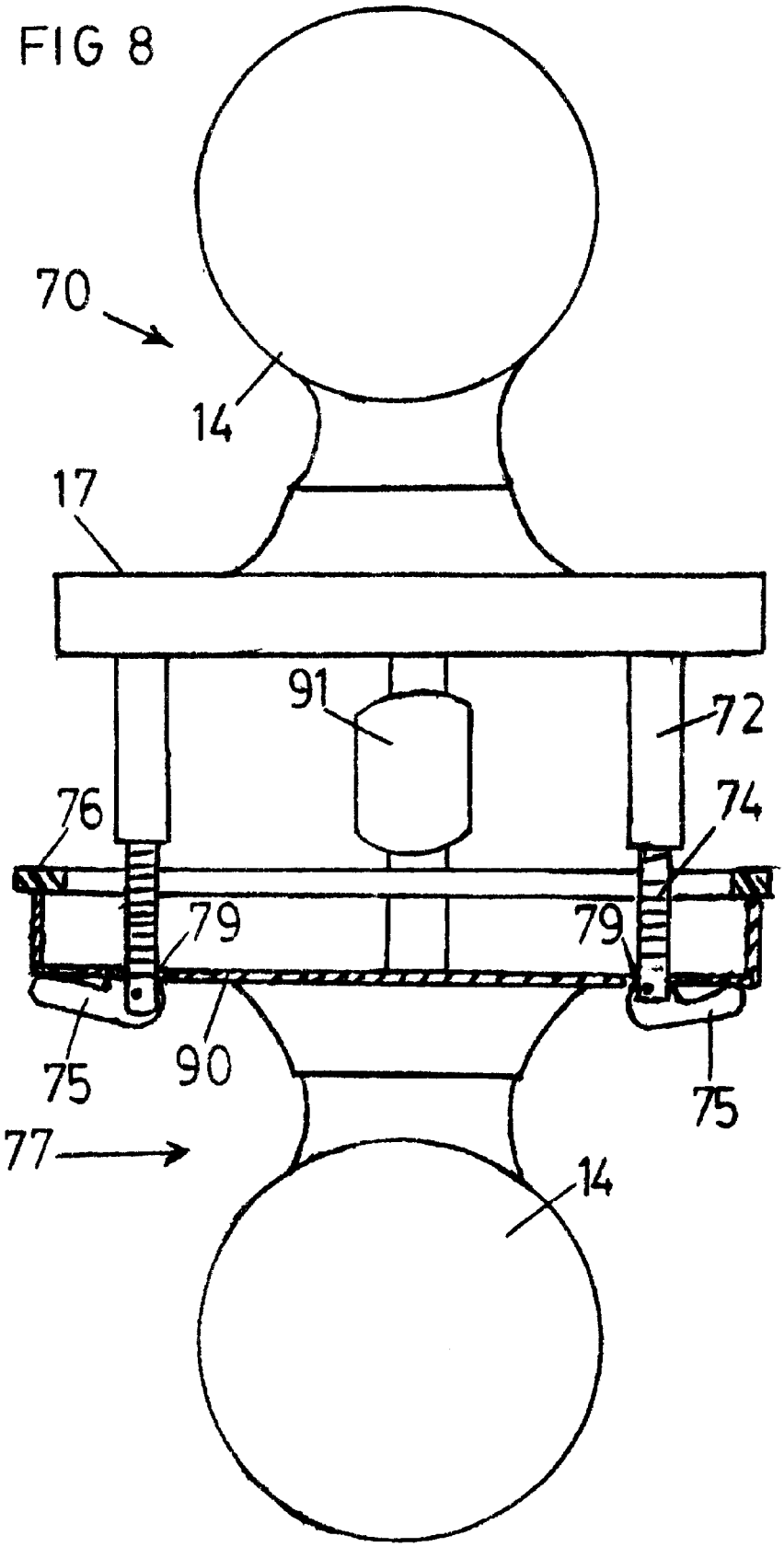
FIG. 8 is a view corresponding to FIG. 1, showing a quick release embodiment of a handled door lock in accordance with the present invention.
Figures 9, 10, 11:
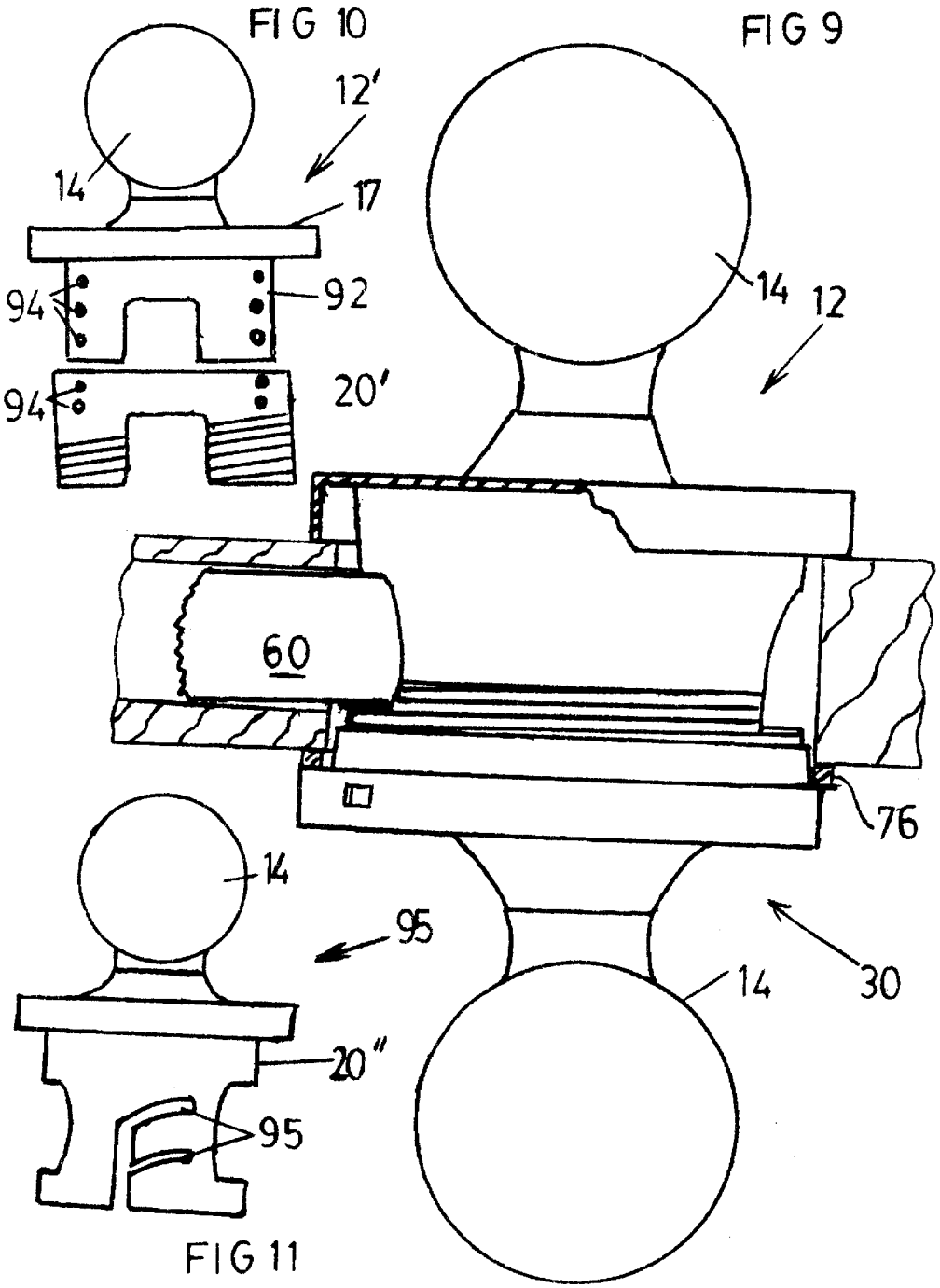
FIG. 9 is a plan view of the elements of FIGS. 1 and 5 (partial) in assembled relation.
FIG. 10 is a side view of an outer portion embodiment of a subject door lock incorporating adjustment provisions to accomodate the lock to two sizes of door; and, FIG. 11 is a top view of a lock portion embodying a portion of a bayonet attachment provision.

Turning to FIG. 5, this shows a standard spring latch mechanism 60 for use with embodiments of FIGS. 1, 8 and 9.

Figure 6:
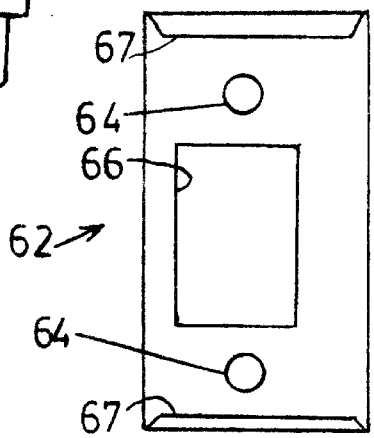
FIG. 6 is a side elevation of a base plate portion of a latch plate assembly.
Figure 7:
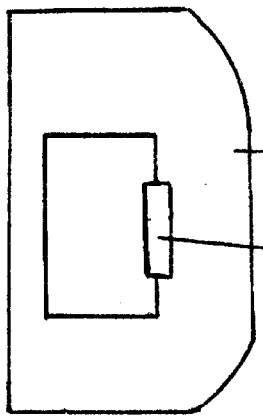
FIG. 7 is a side elevation of a cover plate portion of a latch plate assembly.

FIGS. 6 and 7 illustrate a novel latch plate embodiment for installation in a door jamb, and suitable for use with the present lock embodiments, and with standard existing locks. A base plate portion 62 having attachment holes 64 and bolt aperture 66 is provided with top and bottom inclined flanges 67. A plastic cover plate 68 clip within the flanges 67, while the detent 69 engages the corresponding edge of the bolt apertuture 66.

Referring to the FIG. 8 embodiment, a standard lock outer portion 70 has the usual pair of projecting, internally threaded posts 72. Bolts 74 in accordance with the invention each have a turnbuckle 75 mounted on their ends, being screwed to the posts 72.

An elastomeric gasket 76 may be interposed between the inner surface of the door and lock inner portion 77.

The inner portion 77 of the lock has slots 79 in its inner boss portion 90, to receive the respective turnbuckles 75 in entered relation therethrough, when in a disengaged, raised position. The turnbuckles may be adjusted for their effective length by rotation of the repective bolt 74 in the corresponding post 72. Also, the turnbuckles 75 may have cam portion such that upon operation to a closed position, the cam portions apply closing force, to tension the bolts 74 and compress the gasket 76.

An elastomeric gasket 76 may be used with any of the embodiments, serving as a compression spring to maintain compressive force between the opposed lock portions, and protecting the adjoining door surface, while also generating frictional force to resist rotational back-off in the case of the FIGS. 1, 3 and 4 embodiments.

While illustrated with handles 14, a deadbolt 91 is shown (in end view) as the bolting means. A deadbolt usually incorporates hardware of the type as shown in FIG. 4.

Referring to FIG. 9, this shows the elements of FIG. 1 in mutually assembled relation, including a portion of a latch mechanism 60.

Turning to FIG. 10, this shows an external lock portion 12' having an adjustable mounting arrangement for use with doors of different thickness. Thus, two standard doors, such as two and threequarters inch thickness or two and three eighths inch thickness can be accommodated. A mounting cylinder 92 is illustrated as having two sets of two holes, 94 arranged so that the cylindrical portion 20' can occupy either of two positions, having retaining pins inserted through the respective aligned holes 94.

FIG. 11 shows one half of a two-slot bayonet fitting 95, forming a portion of the cylindrical portion 20". The axial spacing between the two slots 96 makes provision for two thicknesses of door. The mating peg portion of the bayonet fitting, which inserts into one or other of the slots 95, is mounted on the interior of the inner lock portion 37'.

What is claimed is:

1. A door lock for use in locking and unlocking a door, said lock having an outer first portion for installation at an outer face of the door, an inner second portion for installation at an inner face of the door, said lock outer first portion having an inwardly projecting annular cylindrical portion separated by a transverse slot into two, mutually opposed inner end portions each with a threaded surface; said lock inner second portion having an annular threaded surface to receive the threaded surfaces of said first, inner end portions in engaged threaded relation therewith, and annular buttress means sandwiching said first threaded inner end portions with said threaded second portion, to sustain threaded contact between said engaged threaded surfaces, to ensure secure engagement of said lock outer portion with said lock inner portion.

2. The door lock as set forth in claim 1, said lock outer portion transversely extending aperture having a latch portion of said lock in inserted relation therein.

3. The door lock as set forth in claim 2, in combination with said door, and including latchplate means located adjacent said door and said lock, wherein, upon actuation of said lock said latch means engages said latchplate means, to lock said door.

4. The combination as set forth in claim 3, wherein said latchplate means has a base portion for securement to a door jamb by way of screws, and a replaceable cover plate secured in clipped, fixed relation to said base portion in concealing relation with said screws.

5. The door lock as set forth in claim 2, said latch means consisting of a spring latch.

6. The door lock as set forth in claim 2, said latch means consisting of a deadbolt.

7. The door lock as set forth in claim 1, said lock outer first portion having a door handle equipped with a key aperture.

8. The door lock as set forth in claim 6, said lock outer first portion having a key aperture mounted within a mounting boss, said lock inner portion having a narrow latch handle rotatably mounted on a boss portion.

9. The door lock as set forth in claim 1, said first inwardly projecting annular cylindrical portion including axial adjustment means to provide at least two axial positions for said end portion threaded surface, enabling accomodation of said door lock to either one to two doors of predetermined different thickness.

10. The handles of a door lock for use in opening and closing a door, said lock having an outer first handle portion for installation at an outer face of the door, an inner second handle portion for installation at an inner face of the door, said outer and inner handle portions having mutually engageable securing means within the door consisting of a first cylindrical portion having a jug extending radially therefrom; a second cylindrical portion having at least one recess extending about a portion of the periphery thereof, wherein said at least one recess is inclined in an axially extending direction, said lug and said recess forming two complementary halves of a bayonet fitting, said recess receiving said lug such that as said lug is advanced along said recess, in locking relation therewith said outer and said inner handle portions are drawn together in mutually secured relation with said door, one said cylindrical portion having a transverse slot therethrough to receive a latch portion of said lock therein.

* * * * *